US005940098A

United States Patent [19]

Minemoto et al.

[11] Patent Number: 5,940,098

[45] Date of Patent: Aug. 17, 1999

[54] INK-JET PRINTER USING INK CONTAINING PIGMENT PARTICLES

[75] Inventors: Hitoshi Minemoto; Yoshihiro Hagiwara; Ryousuke Uematsu; Junichi Suetsugu; Kazuo Shima, all of Tokyo, Japan

[73] Assignee: NEC Corporation, Tokyo, Japan

[21] Appl. No.: 08/696,659

[22] Filed: Aug. 14, 1996

[30] Foreign Application Priority Data

Aug. 16, 1995 [JP] Japan ..... 7-208864

[51] Int. Cl.[6] ..... B41J 2/06

[52] U.S. Cl. ..... 347/55; 347/10; 347/11; 347/14

[58] Field of Search ..... 347/9, 10, 11, 347/14, 55

[56] References Cited

U.S. PATENT DOCUMENTS 3,914,772 10/1975 Kashio ..... 347/14
5,272,490 12/1993 Murano et al. ..... 347/237

FOREIGN PATENT DOCUMENTS 56-169866 9/1984 Japan ..... 347/11
5254118 10/1993 Japan .
WO93 11866 6/1993 WIPO .

OTHER PUBLICATIONS

Patent Abstracts of Japan, Abstract of JP–A 5–254118.

*Primary Examiner*—Benjamin R. Fuller
*Assistant Examiner*—Christina Annick
*Attorney, Agent, or Firm*—Sughrue, Mion, Zinn, Macpeak & Seas, PLLC

[57] ABSTRACT

The invention relates to an ink-jet printer using an ink containing fine solid particles of a pigment suspended in a carrier liquid. The print head of the printer has an ink ejection orifice at one end of an ink chamber, and the ink chamber is provided with a first electrode to which a DC voltage is applied for concentrating the pigment particles in the ink in the vicinity of the orifice by electrophoresis and a second electrode to which a DC voltage in pulse form is applied for ejecting an agglomeration or several agglomerations of the concentrated pigment particles together with a small amount of carrier liquid from the orifice. The rate of migration of the pigment particles depends on the temperature of the ink. For stable ejection of agglomerations of pigment particles, a temperature sensor is disposed in the ink chamber, and the voltage applied to the first electrode is varied according to the detected temperature of the ink.

10 Claims, 4 Drawing Sheets

E: EJECTION OF AN AGGLOMERATION OF PIGMENT PARTICLES

E: EJECTION OF AN AGGLOMERATION OF PIGMENT PARTICLES

INK-JET PRINTER USING INK CONTAINING PIGMENT PARTICLES

BACKGROUND OF THE INVENTION

This invention relates to an ink-jet printer which uses an ink containing fine solid particles of a pigment suspended in a carrier liquid. More particularly, the ink-jet printer is of the type utilizing electrophoresis of the pigment particles in the ink in an ink chamber of the print head for concentrating the particles in the vicinity of an ink ejection orifice provided at an end of the ink chamber.

In known ink-jet printers of the above-mentioned type, the ink chamber in the print head is provided with a first electrode to which a steady DC voltage is applied to produce an electric field in the ink chamber thereby to induce electrophoresis of the electrically charged pigment particles in the ink toward the ink ejection orifice. As the pigment particles migrate toward the orifice at a definite rate, the particles are concentrated in the vicinity of the orifice. A second electrode is disposed in the ink chamber close to the orifice. After concentrating the pigment particles in the vicinity of the orifice, a DC voltage in pulse form is applied to the second electrode to cause ejection of an agglomeration, or agglomerations, of the pigment particles together with a small amount of the carrier liquid from the orifice toward a recording surface. By repeating this process while the ink chamber is replenished with the ink, an image is printed on the recording surface.

When the pulse duration of the voltage pulse applied to the second electrode is relatively short, a single agglomeration of pigment particles is ejected by each pulse, and this agglomeration of pigment particles forms a single dot on the recording surface. When the pulse duration is relatively long, each pulse causes ejection of a few or several agglomerations of pigment particles one after another at nearly constant time intervals, and on the recording surface these agglomerations form a single dot of a relatively large size. In this case the dot size depends on the number of agglomerations ejected by each pulse.

In the operation of the ink-jet printer described above, there is a problem that by variations in the ambient temperature, the ejection of agglomerations of pigment particles becomes unstable. In the case of ejecting only one agglomeration of pigment particles to form each dot on the recording surface, there arises a possibility of a failure in surely ejecting an agglomeration by each voltage pulse applied to the second electrode. A resultant lack of dots causes degradation of the printing quality In the case of ejecting a plurality of agglomerations of pigment particles to form each dot, the number of agglomerations ejected by each voltage pulse becomes variable so that variations occur in dot size. Nonuniformity of dot size leads to degradation of the printing quality.

SUMMARY OF THE INVENTION

It is an object of the present invention to provide an improved ink-jet printer of the above-described type, which can perform stable ejection of agglomerations of pigment particles irrespective of the ambient temperature and thereby can maintain uniformity of dot size.

An ink-jet printer according to the invention uses an ink containing fine solid particles of a coloring material suspended in a carrier liquid, and the printer comprises a print head comprising (i) an ink chamber to be filled with the ink, (ii) an ink ejection orifice located at one end of the ink chamber, (iii) a first electrode arranged to produce an electric field in the ink chamber such that by electrophoresis induced by the electric field the particles of coloring material in the ink in the ink chamber are concentrated in the vicinity of the orifice, (iv) a second electrode disposed in the ink chamber in the vicinity of the orifice to periodically produce another electric field to eject at least one agglomeration of the particles of coloring material together with a relatively small amount of the carrier liquid from the orifice, and (v) a temperature sensor disposed in the ink chamber to detect the temperature of the ink, and control means for controlling the application of a first DC voltage to the first electrode and a second DC voltage to the second electrode based on externally supplied print information, the control means comprising compensation means for varying at least one of the first DC voltage and the second DC voltage according to the detected temperature of the ink.

Thus, according to the invention a temperature sensor is used to detect changes in the ink temperature in the ink chamber, and the voltage applied to the first electrode and/or the voltage applied to the second electrode are varied according to the detected temperature of the ink. This is for the purpose of avoiding an adverse influence of changes in the ink temperature on the stable ejection of agglomerations of particles of the coloring material which is a pigment.

We have found that the ejection of an agglomeration of the pigment particles from the ink ejection orifice is affected by the viscosity coefficient of the ink containing pigment particles besides some other factors such as the intensity of the electric field in the vicinity of the orifice and the surface tension of the ink; that the viscosity coefficient of an ink containing solid particles of a pigment is liable to vary with temperature and that the rate of electrophoresis of the pigment particles in the ink varies when the viscosity coefficient of the ink varies.

The rate, v, of electrophoresis of the pigment particles toward the ink ejection orifice, viz. the rate of migration of the particles toward the orifice, is given by the following equation:

$$v=(\epsilon_0\epsilon_r\zeta E)/(6\pi\eta)$$

where $\epsilon_0$ is the permittivity in vacuum, $\epsilon_r$ is the relative permittivity of the ink, $\zeta$ is zeta potential, E is the intensity of an electric field acting on the pigment particles in the ink, and $\eta$ is the viscosity coefficient of the ink.

The above equation shows that the rate of the electrophoresis, v, is proportional to the intensity of the electric field E and inversely proportional to the viscosity coefficient $\eta$.

The viscosity coefficient of an ink containing solid particles of a pigment is liable to vary with temperature. Therefore, if the ink temperature varies (in most cases because of a variation in the ambient temperature) the viscosity coefficient of the ink varies, and consequently the rate of electrophoresis of the pigment particles also varies. Variations in the rate of electrophoresis of the pigment particles toward the ink ejection orifice are detrimental to stable ejection of agglomerations of pigment particles from the orifice. In view of these facts, in the present invention, the magnitude of a voltage used to produce an electric field in the ink chamber is varied according to the ink temperature in order to vary the intensity of the electric field so as to compensate variations in the viscosity coefficient of the ink thereby to keep the rate of migration of the pigment particles toward the ejection orifice nearly constant.

It is preferable to vary the magnitude of the voltage applied to the first electrode since the rate of electrophoresis of the pigment particles is primarily determined by the intensity of the electric field produced by this voltage. In general, the viscosity coefficient of an ink containing solid particles of a pigment increases as the ink temperature rises and decreases as the ink temperature lowers. That is, if the voltage applied to the first electrode is constant, the rate of migration of the pigment particles in the ink becomes high when the ink temperature is high and becomes low when the ink temperature is low. Therefore, the voltage applied to the first electrode is lowered when the ink temperature is high and raised when the ink temperature is low. By such control of the voltage applied to the first electrode the rate of migration of the pigment particles toward the ejection orifice (in other words, the quantity of the pigment particles concentrated in the vicinity of the orifice in a given time) is kept stable irrespective of the ink temperature. Therefore, stable ejection of agglomerations of pigment particles can be performed even though the ink temperature varies, so that uniformity of dot size and good quality of printed images can be maintained.

DESCRIPTION OF THE PREFERRED EMBODIMENTS

Figure 1:
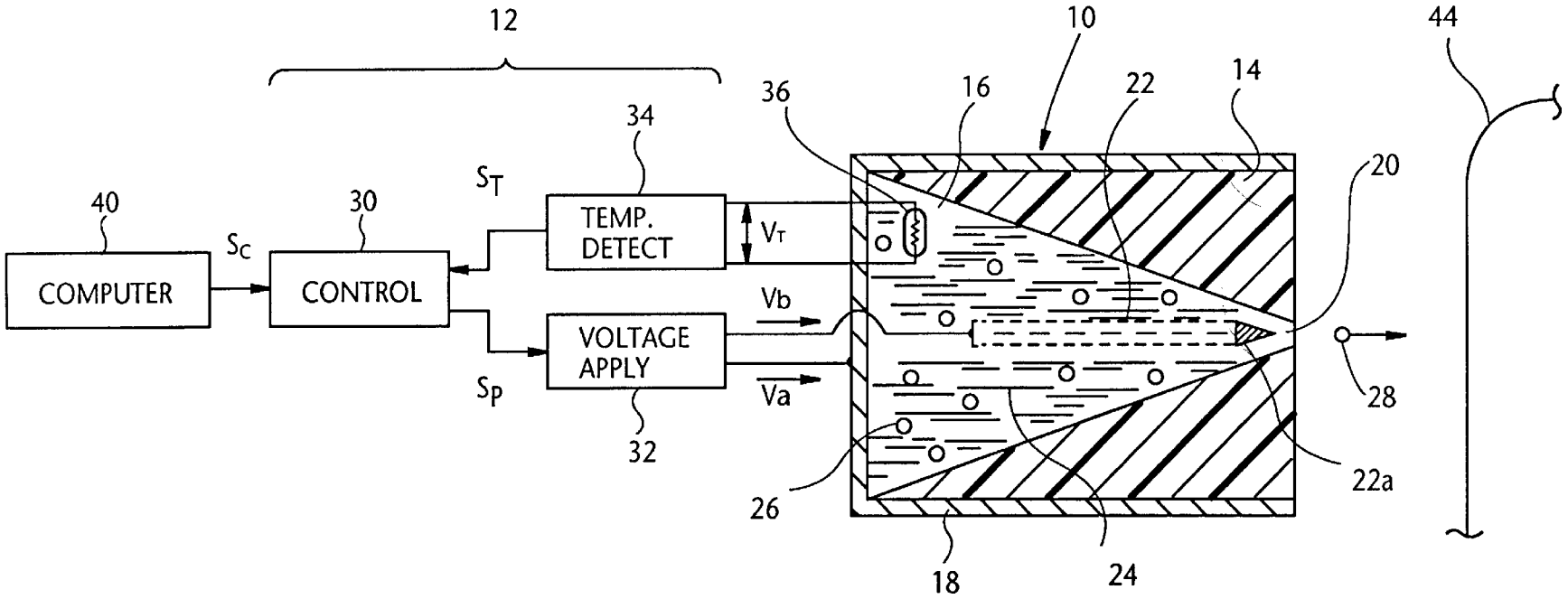
FIG. 1 is a schematic illustration of the principal parts of an ink-jet printer according to the invention.

FIG. 1 shows the principal parts of an ink-jet printer embodying the invention. The printer has a print head 10 and a control part 12 which includes a main control circuit 30, a voltage applying circuit 32 and a temperature detecting circuit 34. In practice, the print head 10 has a plurality of ink ejection orifices. However, for simplicity, FIG. 1 shows only one ink ejection orifice 20.

In the print head 10, an ink chamber 16 for the ink ejection orifice 20 is formed in a dielectric body 14 such as a synthetic resin body. The ink chamber 16 has a conical shape, and the orifice 20 is at the apex of the conical chamber 16. That is, the cross-sectional area of the ink chamber 16 gradually decreases toward the orifice 20. To produce an electric field in the ink chamber 16, an electrode 18 in the shape of a hollow cylinder closed at one end is fitted around the body 14 such that the closed end of the electrode 18 is located at the base end of the conical ink chamber 16. The electrode 18 and the body 14 have the same length so that the orifice 20 is in the center of the open end of the electrode 18. In the ink chamber 16 there is another electrode 22 having a tip 22*a* which is positioned close to the orifice 20 and pointed toward the orifice 20.

The ink chamber 16 is filled with an ink 24, which contains fine solid particles 26 of a pigment (coloring material) suspended in a carrier liquid. The pigment particles 26 in the ink 24 are inherently electrically charged. When an appropriate electric field exists in the ink chamber 16, the electric field causes electrophoresis of the particles 26 such that the particles 26 migrate toward the orifice 20 and are concentrated in the vicinity of the orifice 20. For this purpose, a DC voltage $V_a$ (will be called electrophoresis voltage) is applied from the voltage applying circuit 32 to the electrode 18. When an appropriate DC voltage $V_b$ (will be called ejection voltage) is applied to the electrode 22 after concentrating the pigment particles 26 in the vicinity of the orifice 20, at least one agglomeration 28 of pigment particles 26 together with a small amount of the carrier liquid is ejected from the orifice 20 toward a recording material 44 such as a paper sheet.

The main control circuit 30 of the printer supplies a printing signal $S_p$ to the voltage applying circuit 32 based on print information $S_c$ supplied from a print demanding electronic device 40 such as a personal computer. The print information $S_c$ contains print data and print control signals. The control circuit 30 includes an input-output interface, CPU, ROM and RAM and controls the operation of the voltage applying circuit 32 according to a stored program.

As a temperature sensor to detect the temperature of the ink 24, a thermistor 36 is disposed in the ink chamber 16. The resistance value of the thermistor 36, which varies with the ink temperature, is inputted to the temperature detecting circuit 34 as a voltage signal $V_T$. The temperature detecting circuit 34 makes amplification and some other treatments of the signal $V_T$ to supply a signal $S_T$ representing the detected temperature of the ink to the control circuit 30. Based on the signal $S_T$, the control circuit 30 can modify the printing signal $S_p$ to vary the magnitude of the voltage $V_a$ applied to the electrode 18 from the circuit 32.

Figure 2:
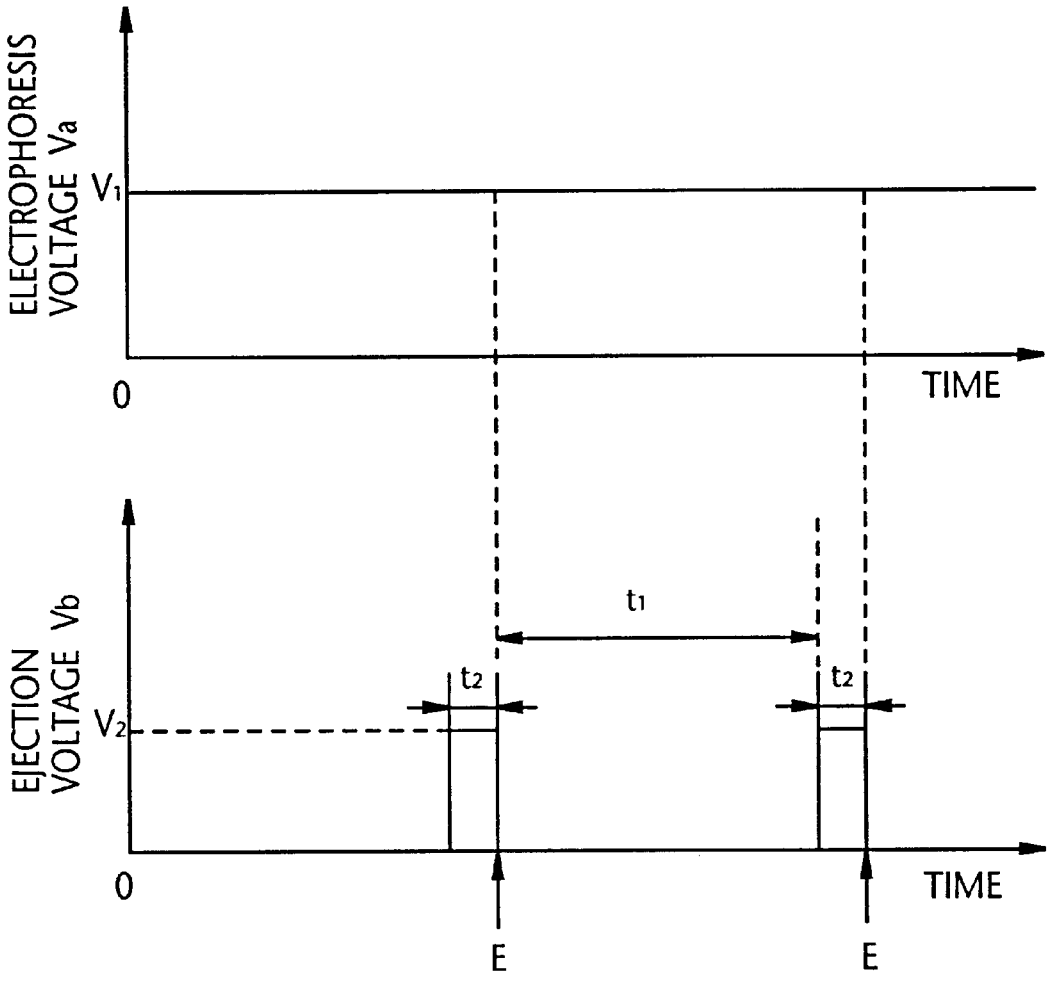
FIG. 2 is a chart showing the operation of the printer of FIG. 1 to print dots of a relatively small size.

Referring to FIG. 2, the fundamental operation of the printer of FIG. 1 is as follows. As the electrophoresis voltage $V_a$, a constant DC voltage $V_1$ is applied to the electrode 18 to produce an electric field in the ink chamber 16. In the electric field the charged particles 26 of the pigment in the ink 24 migrate at a definite speed toward the ink ejection orifice 20, and after a short period of time the particles 26 are concentrated in the vicinity of the orifice 20. Then, as the ejection voltage $V_b$, a DC voltage $V_2$ in the form of a rectangular pulse is applied to the ejection electrode 22 to produce an electric field acting in the direction of the recording material 44 in the vicinity of the orifice 20. In this case the pulse duration $t_2$ of the voltage $V_2$ ($V_b$) is relatively short. By the action of the Coulomb force attributed to this electric field, an agglomeration 28 of pigment particles 26 concentrated in the vicinity of the orifice 20, together with a small amount of the carrier liquid, is ejected from the orifice 20 toward the recording material 44. The ejected agglomeration 28 of particles 26 impinges on the recording material 44 to form a dot. The density of the dot depends on the number of pigment particles 26 in the agglomeration 28. After the ejection of the agglomeration 28 of pigment particles the ink chamber 16 is replenished with the ink 24, and after the lapse of a period of time $t_1$ another pulse of voltage $V_2$ is applied to the electrode 22 to eject another agglomeration 28 of particles 26. By repeating this process an image is printed on the recording material 44.

Figure 3:
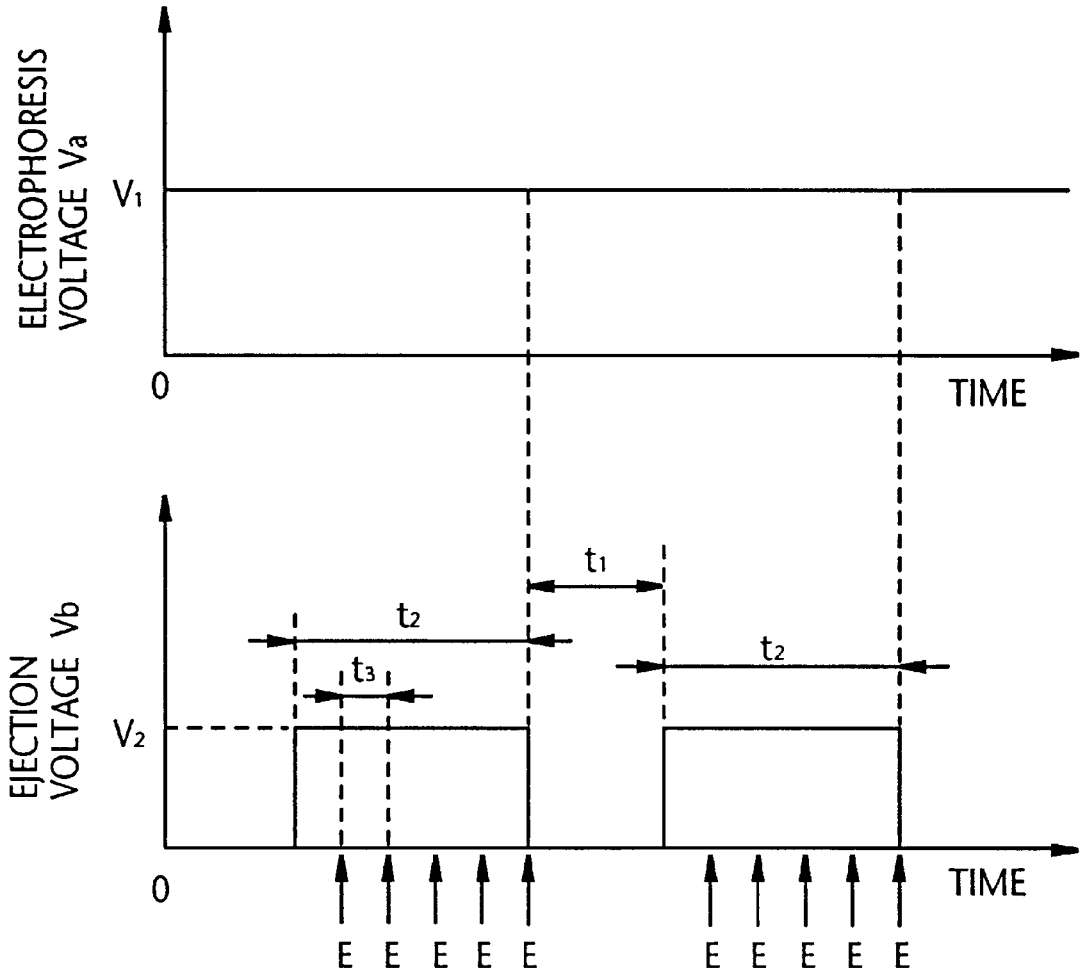
FIG. 3 is a chart showing the operation of the same printer to print dots of a relatively large size.

Referring to FIG. 3, when the pulse duration $t_2$ of the ejection voltage $V_b$ is relatively long, a few or several agglomerations 28 of nearly the same number of pigment particles 26 are ejected one after another at nearly constant time intervals $t_3$, and on the recording material 44 these agglomerations 28 form a single dot of a relatively large size. The dot size depends on the number of agglomerations 28 ejected by each pulse of the voltage $V_b$ ($V_2$). The number of the agglomerations 28 depends on the rate of electrophoresis of pigment particles 26 and, therefore, is affected by several factors such as the intensity of the electric field produced by the voltage $V_a$, viscosity coefficient of the ink 24 and surface tension of the ink.

If the temperature of the ink 24 in the ink chamber 16 varies, the viscosity coefficient of the ink 24 varies, and therefore the rate of electrophoresis of the pigment particles 26 varies. Then the time intervals $t_3$ in FIG. 3 become variable so that the number of the agglomerations 28 ejected by each pulse of the voltage $V_b$ ($V_2$) varies. As a consequence the dots formed on the recording material 44 become nonuniform in size, causing degradation of the quality of the printed image. In the case illustrated in FIG. 2, wherein a single agglomeration 28 of pigment particles is ejected to form each dot, if the ink temperature varies with a resultant variation in the viscosity coefficient of the ink, there arises a possibility of a failure in ejecting an agglomeration 28 of pigment particles by each pulse of the ejection voltage $V_b$. Such failure leads to degradation of the printing quality.

In the present invention, a change in the temperature of the ink 24 is detected by the thermistor 36, and the detected change in the ink temperature is inputted to the control circuit 30 via the temperature detection circuit 34. Based on the temperature signal $S_T$ the control circuit 30 modifies the printing signal $S_p$ to cause the voltage applying circuit 32 to suitably vary the magnitude of the electrophoresis voltage $V_a$ to compensate for the change in the ink temperature.

Figure 4:
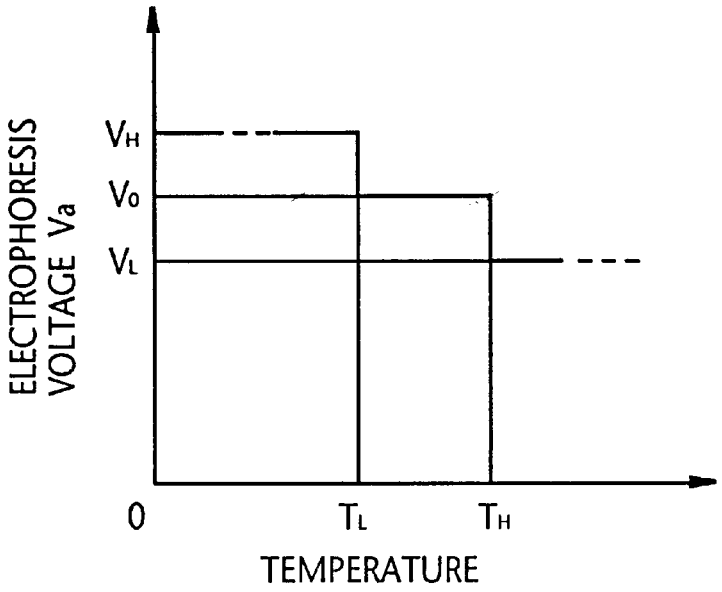
FIG. 4 is a chart illustrating a stepwise change in a voltage applied to the print head of the printer of FIG. 1 with the temperature of the ink in the print head.

For example, as shown-in FIG. 4, the magnitude of the voltage $V_a$ is selected from three levels, viz. high level $V_H$, medium or standard level $V_0$ and low level $V_L$ according to the level of the ink temperature T. When the ink temperature T is below a predetermined relatively high temperature $T_H$ and above a predetermined relatively low temperature $T_L$, the voltage $V_a$ is kept at the standard level $V_0$. The voltage $V_a$ is shifted to the low level $T_L$ when T is not lower than $T_H$, and to the high level $V_H$ when T is not higher than $T_L$. The changes in the magnitude of the voltage $V_a$ cause corresponding changes in the intensity of the electric field produced by the application of the voltage $V_a$ to the electrode 18. Therefore, the rate of electrophoresis of the pigment particles 26 can be kept nearly constant even though the ink temperature T varies. Consequently the time intervals $t_3$ in FIG. 3 become nearly constant, and the number of agglomerations 28 of pigment particles ejected by each pulse of the ejection voltage $V_b$ remains invariable. Therefore, dots of uniform size are formed on the recording material 44 with success in printing an image of good quality irrespective of the ink temperature T. In the case shown in FIG. 2, an agglomeration 28 of pigment particles can surely be ejected by each pulse of the ejection voltage $V_b$.

The three-level control of the voltage $V_a$, shown in FIG. 4, can be modified to another multi-level control wherein more than three ranges of the ink temperature T are defined to select the magnitude of the voltage $V_a$ from more than three different levels which are appropriate to the ink temperature ranges, respectively.

Figure 5:
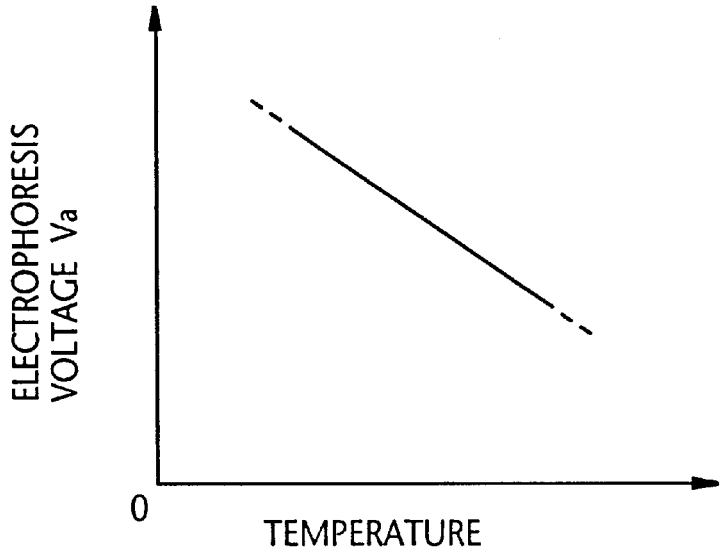
FIG. 5 is a chart illustrating a continuous change in the aforementioned voltage with the ink temperature.

Referring to FIG. 5, another option is continuously varying the magnitude of the voltage $V_a$ in inverse proportion to the ink temperature T.

For the compensation of a change in the ink temperature T, it is possible to vary the magnitude of the ejection voltage $V_b$, or the pulse duration $t_2$ of the voltage $V_b$, instead of or in addition to varying the magnitude of the electrophoresis voltage $V_a$.

What is claimed is:

1. An ink-jet printer which uses an ink containing fine solid particles of a coloring material suspended in a carrier liquid, comprising:

a print head comprising (i) an ink chamber to be filled with said ink, (ii) an ink ejection orifice located at one end of said ink chamber, (iii) a first electrode surrounding said ink chamber to produce an electric field in said ink chamber such that by electrophoresis induced by said electric field said particles in said ink in said ink chamber are concentrated in the vicinity of said orifice, (iv) a second electrode disposed in said ink chamber in the vicinity of said orifice to periodically produce another electric field to eject at least one agglomeration of said particles together with a amount of said carrier liquid from said orifice, and (v) a temperature sensor disposed in said ink chamber to detect the temperature of said ink; and control means for controlling the application of a first DC voltage to said first electrode and a second DC voltage to said second electrode based on externally supplied print information, said control means varying at least one said first DC voltage according to the detected temperature of said ink.

2. An ink-jet printer according to claim 1, wherein said control means lowers said first DC voltage when the detected temperature of said ink is above a first temperature and raises said first DC voltage when the detected temperature is below a second temperature, said first temperature being higher than said second temperature.

3. An ink-jet printer according to claim 2, wherein said first DC voltage is varied stepwise.

4. An ink jet printer according to claim 1, wherein said control means continuously varies said first DC voltage in inverse proportion to the detected temperature of said ink.

5. An ink-jet printer according to claim 1, wherein said temperature sensor is a thermistor.

6. An ink-jet printer according to claim 1, wherein said ink chamber becomes gradually narrower in cross-sectional area from an end opposite to said one end toward said one end.

7. An ink-jet printer according to claim 1, wherein said second DC voltage is in the form of a rectangular pulse.

8. An ink-jet printer according to claim 7, wherein only one agglomeration of said particles is ejected by each pulse of said second DC voltage.

9. An ink-jet printer according to claim 7, wherein a plurality of agglomerations of said particles are ejected at nearly constant time intervals by each pulse of said second DC voltage.

10. An ink jet printer according to claim 2, wherein said control means varies said second DC voltage according to the detected temperature of said ink.

* * * * *

UNITED STATES PATENT AND TRADEMARK OFFICE

CERTIFICATE OF CORRECTION

PATENT NO. : 5,940,098

DATED : August 17, 1999

INVENTOR(S) : Hitoshi MINEMOTO, Yoshihiro HAGIWARA, Ryousuke UEMATSU, Junichi SUETSUGU and Kazuo SHIMA.

It is certified that error appears in the above-identified patent and that said Letters Patent is hereby corrected as shown below:

Column 6, line 9, after "comprising:" insert --a power supply disposed in said printer, said power supply applying a first DC voltage and applying a second DC voltage;--.

Column 6, line 13, after "chamber" insert --by application of the first DC voltage to the first electrode--.

Column 6, line 15, delete "the" and insert --a--.

Column 6, line 18, after "field" insert --by application of the second DC voltage to the second electrode--.

Column 6, line 19, delete "a" and insert --an--.

Column 6, line 21, delete "the" and insert --a--.

UNITED STATES PATENT AND TRADEMARK OFFICE

CERTIFICATE OF CORRECTION

PATENT NO. : 5,940,098

DATED : August 17, 1999

INVENTOR(S) : Hitoshi MINEMOTO, Yoshihiro HAGIWARA, Ryousuke UEMATSU, Junichi SUETSUGU and Kazuo SHIMA It is certified that error appears in the above-identified patent and that said Letters Patent is hereby corrected as shown below:

| | | |
|---|---|---|
| Column 6, | line 23, | delete "a" and insert --said--. |
| Column 6, | line 24, | delete "a" and insert --said--. |
| Column 6, | line 26 and 27, | delete "at least one". |
| Column 6, | line 46, | delete "the" and insert --a--. |
| Column 6, | line 48, | delete "each and insert --the--. |
| Column 6, | line 52, | delete "each" and insert --the--. |

Signed and Sealed this

Twenty-sixth Day of September, 2000

*Attest:*

*Attesting Officer*

Q. TODD DICKINSON

*Director of Patents and Trademarks*